US008070883B2

(12) United States Patent
Hurst

(10) Patent No.: US 8,070,883 B2
(45) Date of Patent: Dec. 6, 2011

(54) PARTICLE REMOVER APPARATUS AND METHODS

(76) Inventor: Richard Francis Hurst, Vero Beach, FL (US)

( * ) Notice: Subject to any disclaimer, the term of this patent is extended or adjusted under 35 U.S.C. 154(b) by 0 days.

(21) Appl. No.: 12/456,294

(22) Filed: Jun. 15, 2009

(65) Prior Publication Data

US 2010/0269855 A1 Oct. 28, 2010

Related U.S. Application Data

(60) Provisional application No. 61/132,043, filed on Jun. 16, 2008.

(51) Int. Cl.
*B08B 7/00* (2006.01)

(52) U.S. Cl. ..... 134/6; 134/10; 134/32; 134/42

(58) Field of Classification Search ..... 134/6, 10, 134/32, 42
See application file for complete search history.

(56) References Cited

U.S. PATENT DOCUMENTS 5,651,846 A * 7/1997 Hurst ..... 156/64
6,164,044 A * 12/2000 Porfano et al. ..... 53/471
2002/0185212 A1* 12/2002 Schaupp et al. ..... 156/205
* cited by examiner

*Primary Examiner* — Michael Kornakov
*Assistant Examiner* — Nicole Blan
(74) *Attorney, Agent, or Firm* — R. M. Saccocio

(57) ABSTRACT

Methods and apparatus for removing particles from vials includes the use of a one sided pressure sensitive filament tape to remove external particles from vials. A roll of tape is juxtaposed relative to a line of vials moving along the production line. As each vial moves within the space between the tape the outside of the vial contacts the tape causing the particles to be removed and imbedded in the adhesive on the tape. A feed roll and a rewind roll provides for the tape to unwind while in contact with the outside of the vials and in conjunction with the movement of the vials along the production line. By causing the feed roll and the rewind roll to advance unused tape while in contact with the outside surface of the vials, the vials are caused to rotate at least 360 degrees while advancing down the line.

1 Claim, 2 Drawing Sheets

PARTICLE REMOVER APPARATUS AND METHODS

This application is related to U.S. Provisional Patent Application Ser. No. 61/132,043, filed Jun. 16, 2008, Entitled Particle Remover apparatus and Methods-.

BACKGROUND OF THE INVENTION

1. Field of the Invention

This invention relates in general to the field of particle removing from an outside surface and in particular to the field of methods and apparatus for removing particles from the outside surface of glass vials.

2. Description of the Prior Art

In the pharmaceutical field it usually not necessary to sterilize the outside of containers within which drugs are stored or contained. The inside of the containers or vials is another matter. In general, the inside surfaces of many drug containing glass vials must be free of contamination so as not to adversely affect the drug there within. New technology has become available to ascertain the lack of contamination within the glass vials; however, an inherent problem in the modern day method of filling of glass vials has prevented the application of the new technology.

The new technology involves automatic inspection of glass vials before the drug is inserted in the vial and after the vials have been filled with the drug. The obvious intent being the speeding up of the vial filling process by automatically inspecting each vile simultaneously with the filling process and thereby improve quality control.

As noted above, one function of the automatic inspection of the vials before being filled with a drug is to ascertain that the insides of the vials are not contaminated with particles. The automatic inspection process attempts to carry out this aspect of the inspection process by sighting through the glass from which the vials are made. The sighting inside the glass vials is accomplished with high-resolution cameras that sight through the sidewalls of said glass vials and can detect particulate contamination inside of the glass vials. Unfortunately because of particulate contamination on the outside of the vials, many vials are rejected in that the camera technology involved cannot distinguish between the presence of inside or outside particles. The result being that the automatic inspection rejects many of the vials even though the insides may be free of particulate matter. This can further result in shutting down the inspection process. For the automatic inspection technology to be effective all particles be removed from the outside of the vials notwithstanding that outside or external contamination is otherwise generally acceptable.

In the prior art, various attempts have been made to remove the external particles. Brushing the outside surface has been tried as has air blasting. While these techniques work to some degree, they are ineffective because the particles travel in all directions and simply lodge onto other vials. Vacuuming of the particles has also been attempted, but this method has been shown not to be reliable and or sufficiently effective.

The present invention substantially eliminates the above described problem by providing simple and completely effective methods and apparatus for removing particulate matter from the outside of glass vials such that the inspection and filling of the vials can thereafter be accomplished.

SUMMARY OF THE INVENTION

The above-stated objects as well as other objects which, although not specifically stated, but are intended to be included within the scope the present invention, are accomplished by the present invention and will become apparent from the hereinafter set forth Detailed Description of the Invention, the Drawings, and the Claims.

The present invention comprises the use of a one sided pressure sensitive filament tape to remove external particles from vials. A roll of tape is juxtaposed relative to a line of vials moving along the production line. As each vial moves within the space between the tape the outside of the vial contacts the tape causing the particles to be removed and imbedded in the adhesive on the tape. A feed roll and a rewind roll provides for the tape to unwind while in contact with the outside of the vials and in conjunction with the movement of the vials along the production line.

By causing the feed roll and the rewind roll to advance unused tape while in contact with the outside surface of the vials, the vials are caused to rotate at least 360 degrees while advancing down the line. In this manner, all particles are removed from the entire outside surface of each vial and then the high resolution camera or cameras can view the inside of the vials which are now free of any outside contamination.

In accordance with the above, there has been summarized the more important features of the present invention in order that the detailed description of the invention as it appears in the below detailed description of the same, may be better understood.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functioning details disclosed herein are not to be interpreted as limiting, but merely as a basis for the claims and as a representative basis for teaching one skilled in the art to variously employ the present invention in virtually any appropriately detailed structure. Additionally, the verbiage used herein is intended to better enable a person to understand the invention and therefore, such verbiage is not to be interpreted as limiting the invention.

Figure 1:
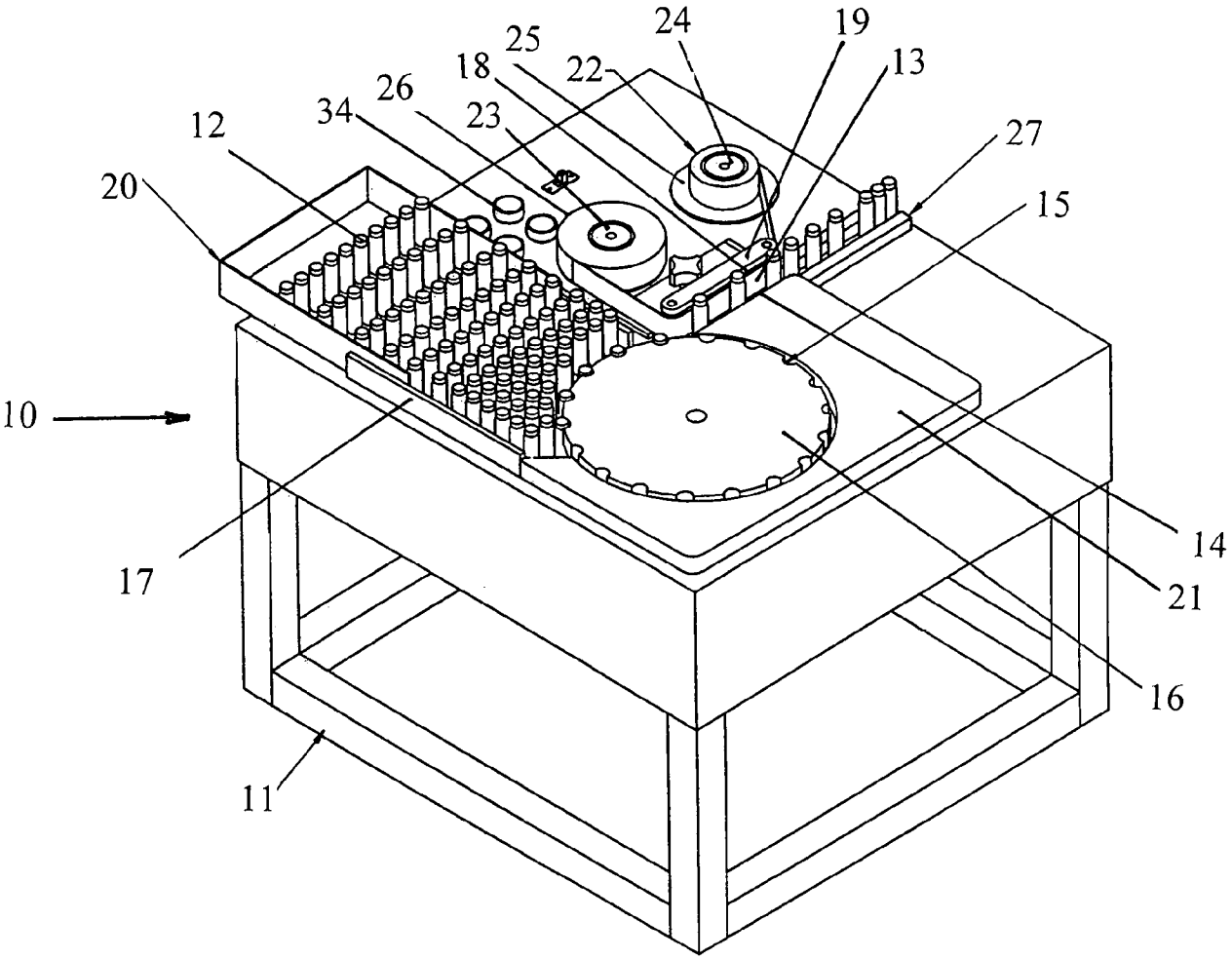
FIG. 1 is an isometric view of one embodiment of the present invention; and, FIG. 2 is a bottom isometric view of the embodiment of FIG. 1. with the frame members not being shown.

Reference is now made to FIG. 1 of the drawings wherein the overall configuration of the invention is shown isometrically. A suitable stand 11 can be used to mount the operative components of the particle removing apparatus 10. Alternatively, the components 10 can be mounted within the assembly line prior to the appropriate inspection point. The stand alone configuration of FIG. 1 has the advantage of not requiring extensive changes to an already existing production and inspection line.

In the shown configuration, the vials 12 are fed from an inclined vial tray 20 onto a conveyor 17 and then into pockets 15 of a rotating index wheel 16. The inclined tray allows gravity to move the vials onto the conveyor 14. From the conveyor, each vial is directed to a pocket or circular cutout 15 of the rotating disc 16 and-into the entrance of track-13. The particle removing process is accomplished within track 13. In a simple embodiment, the vials can be hand fed; of course mechanical conveying means as depicted in FIG. 1 can also be used and is preferred. In this manner each vial is directed into the particle removing track 13. with each vial be appropriately spaced from another. The height of the track 13 must be sufficient to prevent the vials from tipping over when passing there along.

The particle removing track-13. can comprise the space between an inner edge 14 of a plate 21 which surrounds a rotating disc 16 and the inner edge 18 of an adjustable bar 19. Again, the height of track 13 must be of a sufficient height to prevent the vials from tipping over. One function of the inner edge 14 of plate 21 is to provide additional vertical support and sufficient friction to the vials while advancing along track 13 and to cause the vials to rotate at least 360 degrees while advancing forward.

Once the vials 12 are fed into track 13 they are assisted in moving and rotating about their axial centerline by means of a one sided pressure sensitive adhesive tape 22. Tape 22 is mounted on a feed roller 23 an end of which is stretched along track 13 and then taken by a rewind roller 24. The filament of tape 22 between rollers 23 and 24 and within track 13 is pressed up against the inner edge 18 of bar 19 with the adhesive side of the tape 22 pressed up against the outside surface of the vials 12. Bar 19 is adjustable so as to increase or decrease the width of track to accommodate the diameter of vials 12. Plate 21 can also be adjustable so as to assist in defining the width of track 13 as well as the compressive force of the tape 22 against the outside diameter of vial 12.

The A pair of rollers 23 and 24 are rotationally secured to the top of stand 11 by rotatable plates 25 and 26 or by any other suitable means. One roller, for example roller 24, can be a drive roller while roller 23 can be somewhat free to rotate. In this manner, roller 24 is a wind up roller and roller 23 is a feed roller. A certain amount of friction or drag can be associated with feed roller 23 such that roller 23 is controlling as explained below. The drag can be applied by a spring washer sandwiched between a pair of friction discs and a tightening knob(not shown) as used in fishing reels or by any other known method of applying drag to the free to rotate roller 23. Simple bearings can be mounted to shafts of the rollers to reduce friction and maintain vertical alignment of the rollers. Roller 23 is positioned in the approximate vicinity of the entrance to track 13. Roller 24 can be positioned in the approximate vicinity of the exit of track 13.

In use, in the example shown, a roll of tape 22 is positioned on roller 23. A free end of the tape 22 is pulled from roller, threaded though track 13 and secured to roller 24. The drag associated with roller 23 provides for the length of tape 22 between the rollers and within the track 13 to be held taut and positioned flat against surface 18 of track 13. The adjustable bar 19 and the movable plate 21 are then adjusted such that an appropriate amount of spring or compressive force in conjunction with the adhesive side of tape 22 against the vials 12 is applied to the vials 12 to cause the at least 360 degree rotation of the vials as they progress along track 13.

As noted above, tape 22 has adhesive on one side thereof which side is positioned up against the vials within track 13 As each vial is feed into track 13 contact with the adhesive side of tape 22 is obtained. The driven wind up roller 24 causes each successive vial to rotate and be advanced along track 13. The surface tension applied by bar 19 must provide sufficient friction so that the vials are prevented from slipping when traveling along track 13. For example, such friction can be provided by an elastomeric coating on surface 19. Any particulate matter on the outside of the vials is thusly removed and imbedded in the adhesive on the tape 22. Further, because the removed particles are imbedded in the tape, the removed particles are not free to travel and cannot settle on previously decontaminated vials. Upon completion of the particle removal process, the vials exiting from track 13 can be directed to another track 27 formed by appropriate rails in order to maintain their lineal and vertical position before advancing to the camera inspection station or to a location in accordance with their processing.

It is preferable that the particle removal operation be carried out in a dust free environment so that no new dust adheres to the outside of the vials before the camera inspection process. After the camera inspection of the vials is accomplished, it is of no matter if the vials again become contaminated on their outside surface.

Figure 2:
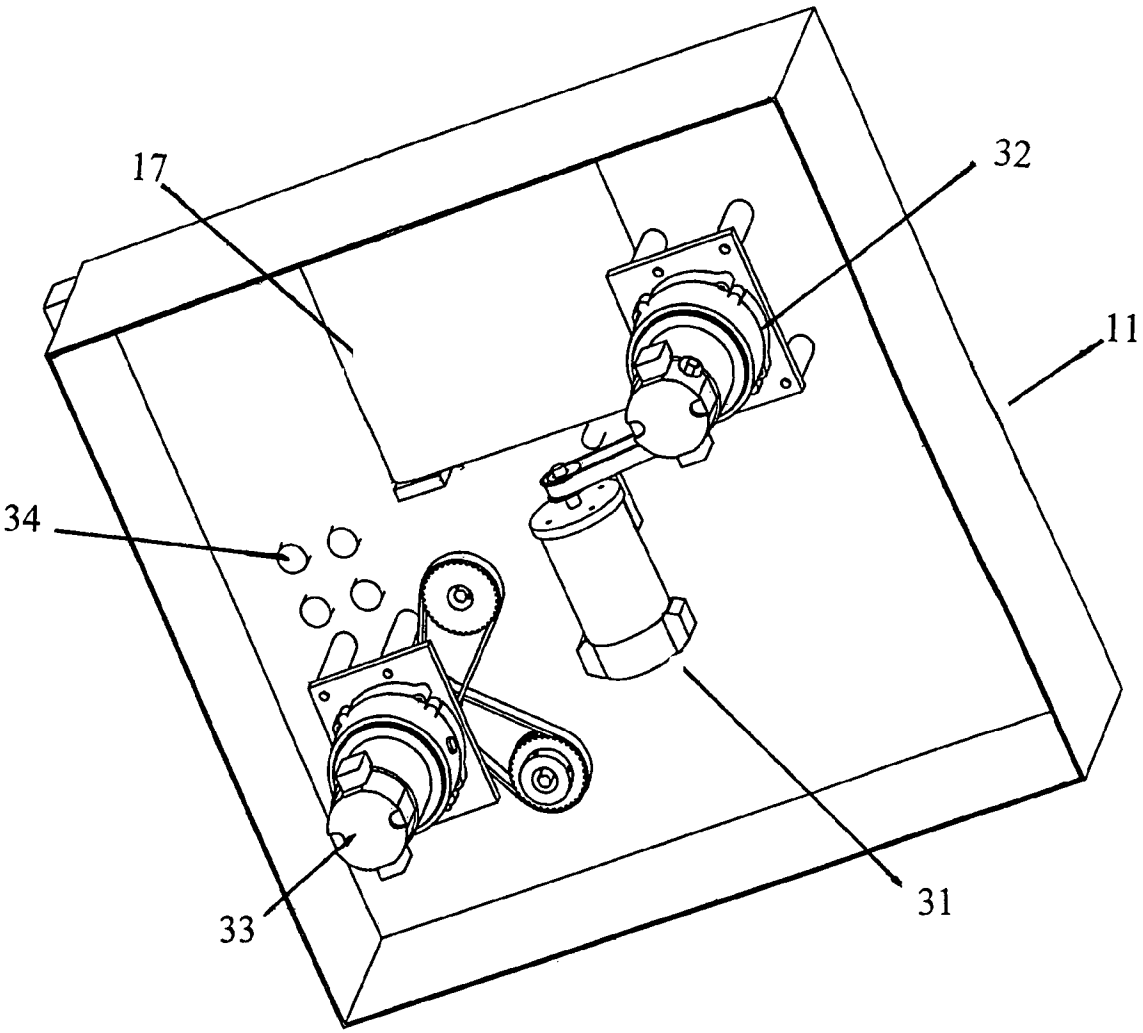

As the tape 30 is used up, it can be reused (by inverting and replacing the tape on the reverse rollers) or discarded in an appropriate manner and a new roll of tape be placed on roller 27 and the process can continue FIG. 2 illustrates the use of the electrical motors 34 and 35 used with the inventive particle removing apparatus and methods which motors are positioned on the underside of the top surface of stand 11. Motor 34 drives the tape rollers 23 and 24. Motor 31 drives the indexing wheel 16. Motor 32 drives the horizontal conveyor.

A forward reverse switch 35 provides for the tape rollers 23 and 24 to reverse in direction. For example, when all of the tape from roll 23 has been used and transferred to roller 24, and while bar 19 has been adjusted to not contact the vials, the direction of travel of rollers can be reversed causing the tape to be rewound onto roller 23. In this manner the tape can be reused again and again until it can no longer remove all of the particles from the outside surface of the vials.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breath and scope of the drawings and description provided herein.

I claim:

1. A method for removing particulate matter from the outside surface of medicinal vials comprising the steps of:

positioning a roll of tape having adhesive on one side thereof on a feed roller, extending a free end of the tape through an entrance to a track and exiting the free end from a remote end of the track, attaching the free end of the tape from the remote end of the track to a wind up roller such that a length of the tape extends from the feed roller to the wind up roller and within the track, tensioning the length of tape between the rollers and up against one side of the track with the adhesive side of the tape facing outward from the one side of the track, directing the vials in a successive order into the track, applying a side force to the vials within the track such that the adhesive side of the tape is firmly positioned against the vials, rotating the wind up roller such that the tape unwinds from the feed roller and the friction between the adhesive and the vials cause the vials to rotate and advance within the track causing the particulate matter to be imbedded within the advancing adhesive.

* * * * *